US011230833B2

(12) United States Patent
Thompson

(10) Patent No.: US 11,230,833 B2
(45) Date of Patent: Jan. 25, 2022

(54) ADDITIVE DISPENSER

(71) Applicant: Kohler Mira Limited, Gloucestershire (GB)

(72) Inventor: Ian Thompson, Gloucestershire (GB)

(73) Assignee: KOHLER MIRA LIMITED, Gloucestershire (GB)

( * ) Notice: Subject to any disclaimer, the term of this patent is extended or adjusted under 35 U.S.C. 154(b) by 132 days.

(21) Appl. No.: 16/713,658

(22) Filed: Dec. 13, 2019

(65) Prior Publication Data

US 2020/0131750 A1 Apr. 30, 2020

Related U.S. Application Data

(63) Continuation of application No. PCT/GB2018/051782, filed on Jun. 26, 2018.

(30) Foreign Application Priority Data

Jun. 27, 2017 (GB) ..... 1710233

(51) Int. Cl.
*E03D 9/02* (2006.01)
*E03C 1/046* (2006.01)

(52) U.S. Cl.
CPC ..... *E03D 9/02* (2013.01); *E03C 1/046* (2013.01); *E03D 2009/028* (2013.01)

(58) Field of Classification Search
CPC ..... E03D 9/02; E03D 2009/028
USPC ..... 4/224, 225.1–227.1, 227.6–227.7
See application file for complete search history.

(56) References Cited

U.S. PATENT DOCUMENTS

| | | | |
|---|---|---|---|
| 3,106,345 | A | 10/1963 | Wukowitz |
| 3,890,657 | A | 6/1975 | Gray |
| 4,085,868 | A | 4/1978 | Blair |
| 4,225,085 | A | 9/1980 | Headen et al. |
| 4,432,105 | A | 2/1984 | Pitroda |
| 4,971,105 | A | 11/1990 | McGuire |
| 5,004,158 | A | 4/1991 | Halem et al. |
| 5,071,070 | A | 12/1991 | Hardy |

(Continued)

FOREIGN PATENT DOCUMENTS

| | | |
|---|---|---|
| CN | 1347346 | 5/2002 |
| CN | 101273854 | 10/2008 |

(Continued)

OTHER PUBLICATIONS

EP Extended European Search Report dated Sep. 23, 2020 (8 pages).

(Continued)

*Primary Examiner* — Tuan N Nguyen
(74) *Attorney, Agent, or Firm* — Foley & Lardner LLP

(57) ABSTRACT

A liquid dosing apparatus for dispensing a liquid from a container into a liquid stream of a shower, toilet, or tap includes a dosing mechanism that includes a dosing chamber and a moveable member. The dosing mechanism is arranged to draw a set volume of the liquid into the dosing chamber on activation by moving the moveable member in a first direction. The apparatus further includes a damping control system arranged to control a dispensing rate of the set volume of the liquid by controlling return speed of the moveable member, as well as a dispensing outlet arranged to dispense the liquid into the water stream at the controlled dispensing rate.

9 Claims, 6 Drawing Sheets

(56) References Cited

U.S. PATENT DOCUMENTS

| | | | | |
|---|---|---|---|---|
| 5,404,594 | A | 4/1995 | Ring et al. | |
| 6,045,060 | A | 4/2000 | Hudson | |
| 6,419,166 | B1 * | 7/2002 | Brzezinski | E03C 1/046 222/395 |
| 6,851,626 | B2 | 2/2005 | Patel et al. | |
| 7,156,324 | B2 | 1/2007 | Birrenkott et al. | |
| 8,820,660 | B2 | 9/2014 | Ajagbe | |
| 9,022,073 | B2 | 5/2015 | Strauli | |
| 9,079,204 | B1 | 7/2015 | Hattenbrun | |
| 9,085,006 | B2 | 7/2015 | Wu et al. | |
| 9,303,392 | B2 | 4/2016 | Strauli | |
| 9,438,977 | B2 | 9/2016 | Wang et al. | |
| 9,821,279 | B2 | 11/2017 | Pasquier et al. | |
| 2002/0070292 | A1 | 6/2002 | Hazenfield | |
| 2007/0119980 | A1 | 5/2007 | Somerfield et al. | |
| 2011/0073137 | A1 | 3/2011 | Dvorak et al. | |
| 2013/0042653 | A1 | 2/2013 | Acharya | |
| 2013/0175350 | A1 | 7/2013 | Marks | |
| 2014/0151464 | A1 | 6/2014 | Cheng | |
| 2016/0088927 | A1 | 3/2016 | Knight | |
| 2017/0201716 | A1 | 7/2017 | Humphries | |
| 2019/0093324 | A1 * | 3/2019 | Backus | E03C 1/0465 |
| 2020/0181893 | A1 * | 6/2020 | Mock | E03C 1/046 |

FOREIGN PATENT DOCUMENTS

| | | |
|---|---|---|
| CN | 101454085 | 6/2009 |
| CN | 204199384 | 3/2015 |
| CN | 205676979 | 11/2016 |
| CN | 206120177 | 4/2017 |
| CN | 106829176 | 6/2017 |
| DE | 25 29 156 | 1/1977 |
| DE | 19744063 | 4/1999 |
| EP | 1 252 934 | 10/2002 |
| EP | 1 474 196 B1 | 11/2004 |
| FR | 3062552 | 2/2017 |
| GB | 2 019 235 | 10/1979 |
| WO | WO-01/02652 | 1/2001 |
| WO | WO-2014/053779 | 4/2014 |
| WO | WO-2017/201716 | 11/2017 |
| WO | WO2019002845 | 1/2019 |
| WO | WO-2020/243438 | 12/2020 |

OTHER PUBLICATIONS

Getting Started—How Aroma Sense Works. Vitamin C Cartridge. 2019. https://www.aromasenseusa.com/get-started/ dated Apr. 29, 2019 (5 pages).

The Cirrus Technology. Aromatherapy in Your Shower. 2019. https://cirrus-shower.com/pages/the-cirrus-technology dated Apr. 29, 2019 (4 pages).

Search Report re Application No. GB1710233.6 dated Sep. 28, 2017, 3 pages.

Moen, "INC20803 INLY Aromatherapy Shower Capsule 5-Pack, Sweet Morning," Amazon, retrieved May 17, 2021 from https://www.amazon.com/Moen-INC20803-Aromatherapy-Capsule-Morning/dp/B086CQWR7L (published Mar. 31, 2020), 8 pages.

* cited by examiner

ADDITIVE DISPENSER

CROSS-REFERENCE TO RELATED PATENT APPLICATIONS

The present application is a Continuation of International Application No. PCT/GB2018/051782, filed Jun. 26, 2018, which claims priority to and the benefit of United Kingdom Priority Application No. 1710233.6, filed Jun. 27, 2017. The disclosures of each of the foregoing references are incorporated herein by reference in their entireties.

BACKGROUND

This application relates to a dosing apparatus for dispensing a set volume of a non-gaseous fluid at a set rate. The concepts disclosed herein may have particular application for sanitary applications, such as adding an essential oil, soap, shower gel or the likes to a water stream in a shower, tap or toilet, to absorbent scent pads, hand towels, or the likes, but it need not be limited to these uses. The application also relates to an adapter arranged to be removably attachable to both the dosing apparatus, of which it may form a part, and a standard essential oil bottle, and to fluidly connect the essential oil bottle to the dosing apparatus.

In the prior art, it is known to add bath oils, aromatherapy oils, and/or other additives to water streams, for example in showers, bidets, toilets, baths and basins. The rate at which the additive is dispensed is influenced by the flow rate of the water stream, however, which can lead to unexpected effects for a user (e.g. a pressure surge early in a shower resulting in their being no fragrance left when desired).

More precise control of the volume of additive dispensed is also desirable, so as to extend the useful life of a container of additive, and/or to achieve more consistent results.

In addition, it can be difficult to switch between additives during or between uses.

The concepts disclosed herein seek to address one or more of these issues.

The skilled person will appreciate that these issues do not relate solely to sanitary applications; for example being applicable to dispensing syrup for mixing drinks, or adding vitamins and minerals to drinks or the likes. Similarly, the apparatus disclosed herein could be used to dispense cleaning fluid to clean a toilet, sink or the likes rather than to clean or fragrance a user. Further, the additive may not be dispensed into a water stream, but rather, for example, onto a pad of absorbent material in a bathroom heater or hand dryer to enhance scent dispersion.

SUMMARY

An exemplary embodiment relates to a liquid dosing apparatus for dispensing a liquid from a container into a liquid stream of a shower, toilet, or tap. The apparatus includes an adapter arranged to detachably receive the container; a dosing mechanism comprising a dosing chamber and a moveable member, and arranged to draw a set volume of the liquid into the dosing chamber on activation, activation comprising moving the moveable member in a first direction; a damping control system arranged to control a dispensing rate of the set volume of the liquid by controlling return speed of the moveable member; and a dispensing outlet arranged to dispense the liquid into the water stream at the controlled dispensing rate.

Another exemplary embodiment relates to a dosing apparatus for dispensing a liquid through a dispensing outlet. The dosing apparatus includes an adapter arranged to engagingly receive a container of liquid and comprising a first one-way valve arranged to allow liquid flow out of the container and prevent liquid flow into the container. The dosing apparatus also includes a dosing mechanism comprising a dosing chamber and a moveable member, and arranged to draw a set volume of the liquid into the dosing chamber on activation, activation comprising moving the moveable member in a first direction. The dosing apparatus further includes a damping control system arranged to control dispensing rate of the set volume of the liquid. The damping control system includes a hydraulic piston within a charging chamber containing hydraulic fluid, wherein the hydraulic piston is arranged to be driven so as to move a quantity of hydraulic fluid from the hydraulic charging chamber and through a second one-way valve and to a sprung damping chamber when the dosing mechanism is activated. The damping controls system also includes a return channel across the second one-way valve, wherein the return channel is arranged to limit the rate at which the hydraulic fluid can pass therethrough. The sprung damping chamber is arranged to absorb the volume of the displaced hydraulic fluid while creating a spring force to complete a return cycle of the dosing mechanism, the spring force driving the hydraulic fluid in the return direction via the flow valve.

Another exemplary embodiment relates to an adapter for an aromatherapy oil bottle, the adapter being releasably attachable to a dosing apparatus. The adapter includes a thread arranged to engagingly receive the neck of the bottle, so as to form a seal therewith. The adapter also includes an outlet arranged to allow a liquid within the bottle to pass therethrough and a one-way valve arranged to allow air into the bottle. The one-way valve is arranged such that air can enter the bottle only when the liquid is drawn out of the bottle via the outlet. The outlet is arranged such that the liquid cannot pass through the outlet unless a force is applied to the liquid.

BRIEF DESCRIPTION OF THE DRAWINGS

Embodiments will now be described in more detail by way of example only with reference to the accompanying drawings in which like reference numerals are used for like features.

DETAILED DESCRIPTION

Figure 1:
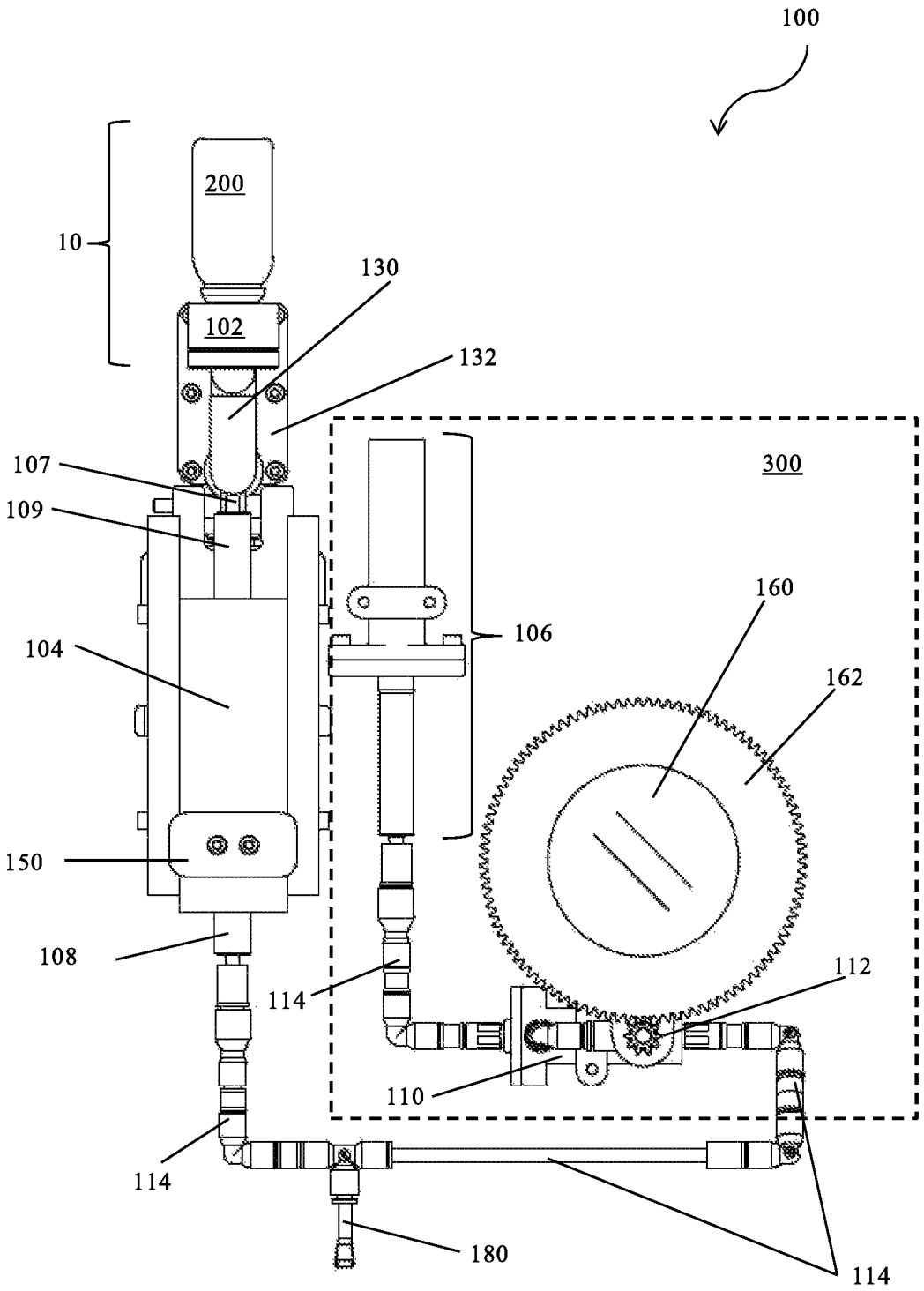
FIG. 1 is a schematic front view of a dosing apparatus of an embodiment.
Figure 2:
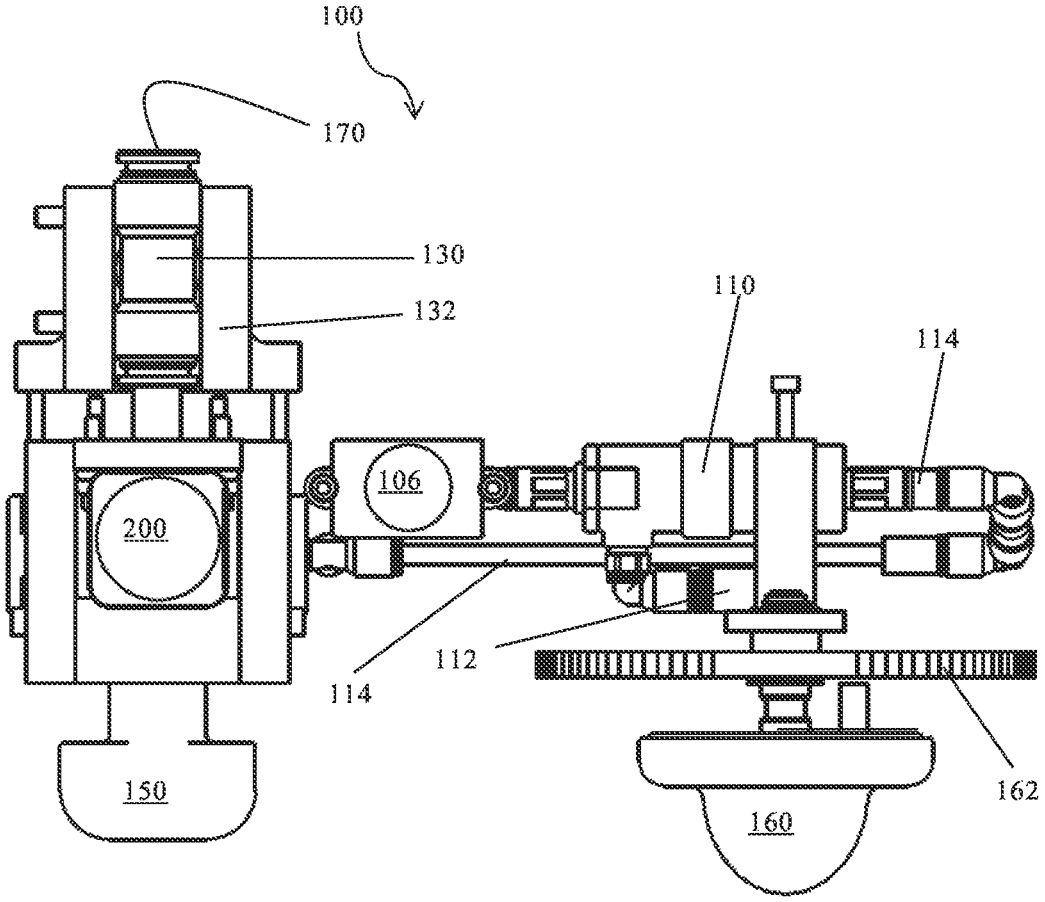
FIG. 2 is a schematic top view of the dosing apparatus of FIG. 1.
Figure 3:
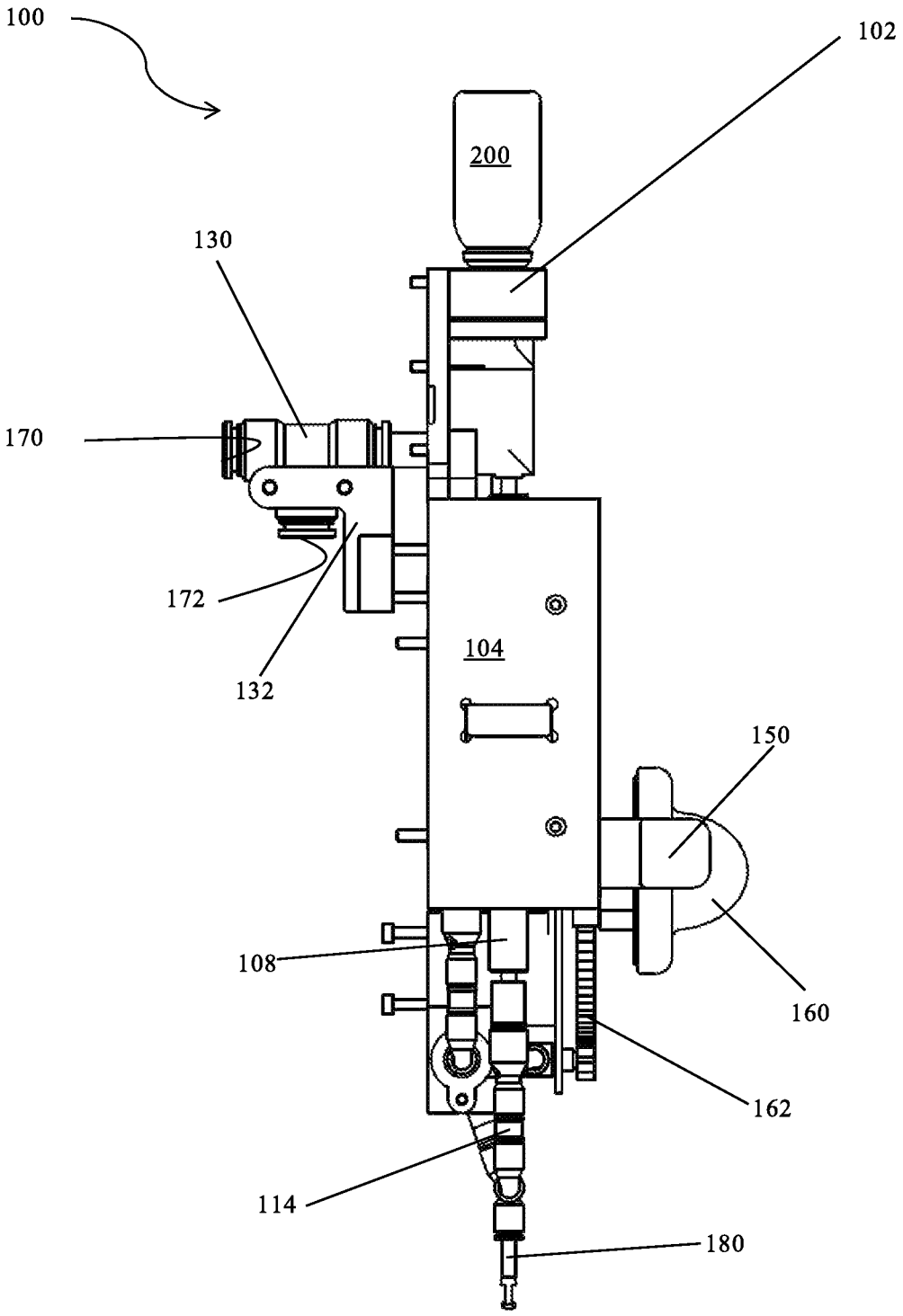
FIG. 3 is a schematic side view of the dosing apparatus of FIG. 1.
Figure 4:
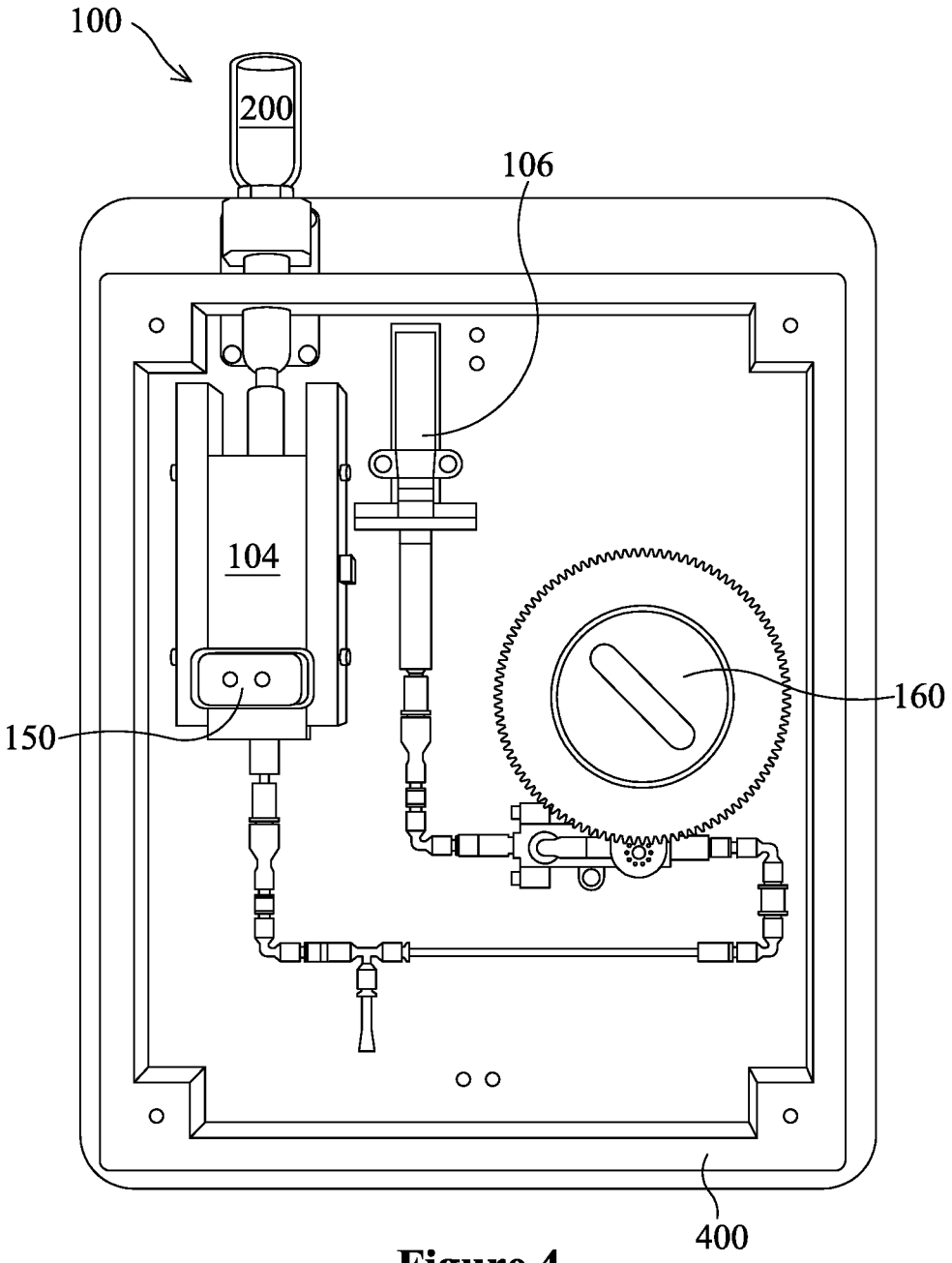
FIG. 4 shows a front view of the dosing apparatus of FIG. 1 within a housing, with the front of the housing removed.
Figure 5:
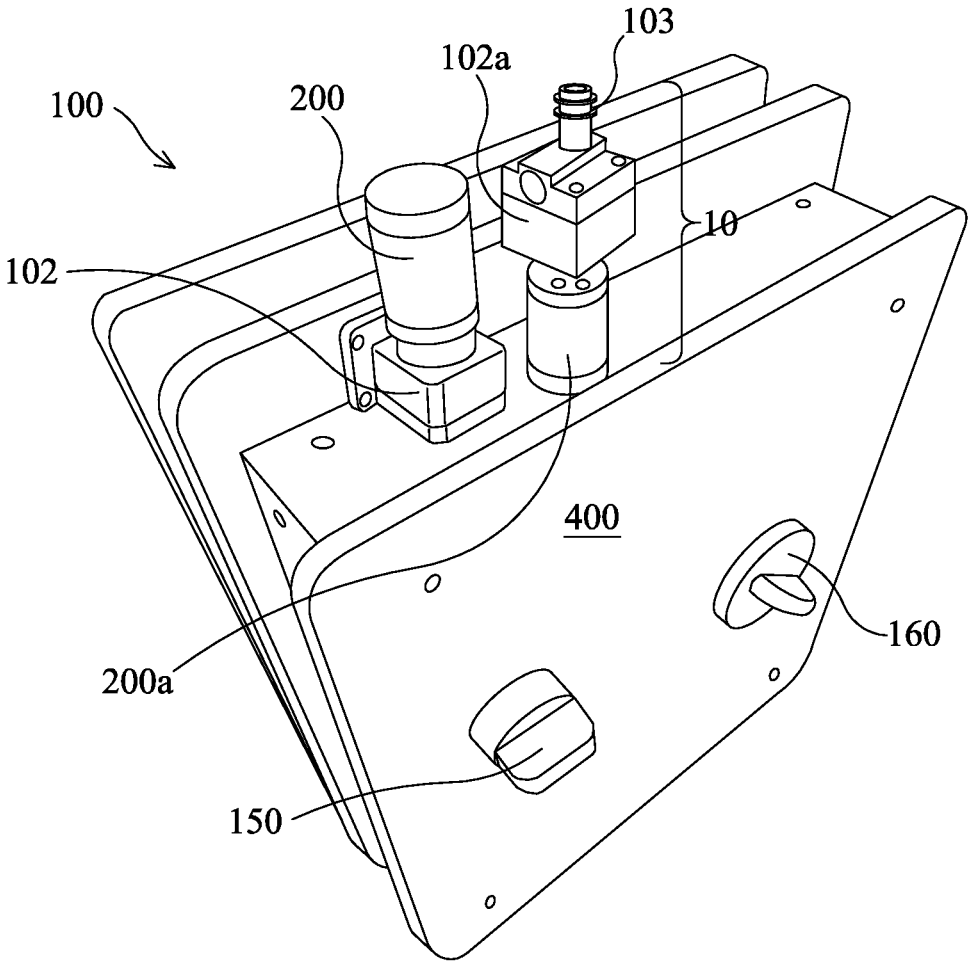
FIG. 5 shows a perspective view of the dosing apparatus and housing of FIG. 4, with the front of the housing in place and a spare container and adapter placed on the top of the housing.
Figure 6:
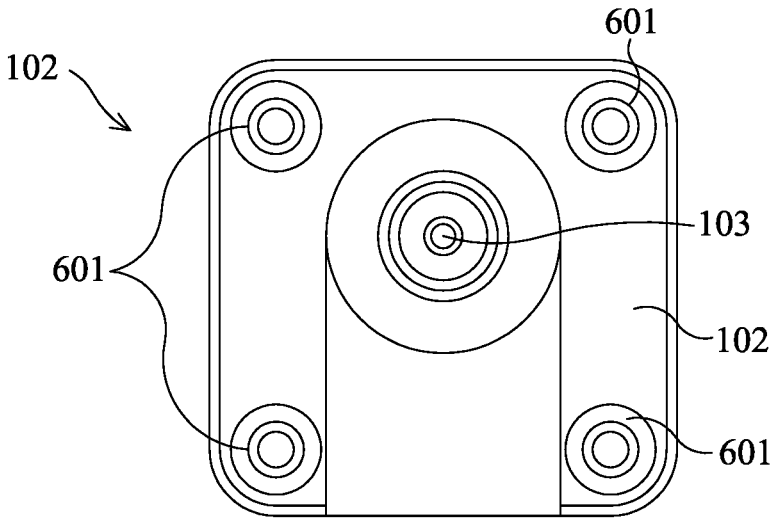
FIG. 6 shows a schematic underneath view of the container and adapter shown in the earlier Figures.
Figure 7A:
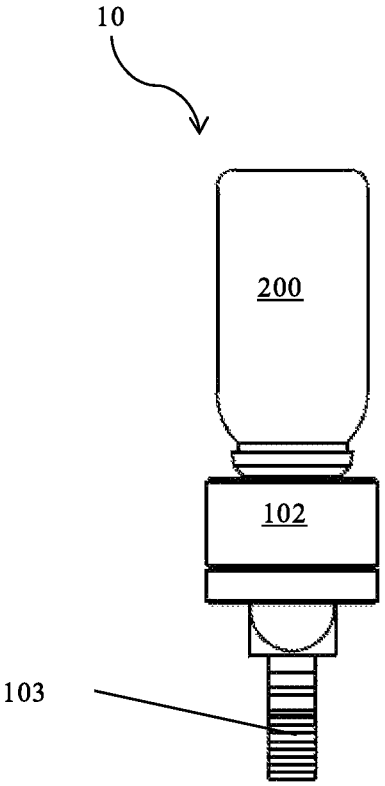
FIGS. 7*a*, 7*b* and 7*c* show schematic side views of the container and adapter shown in the earlier Figures.
Figure 7B:
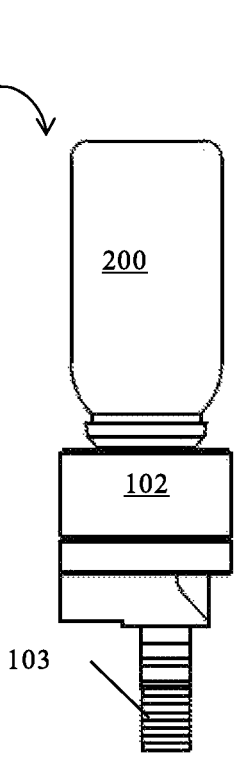
Figure 7C:
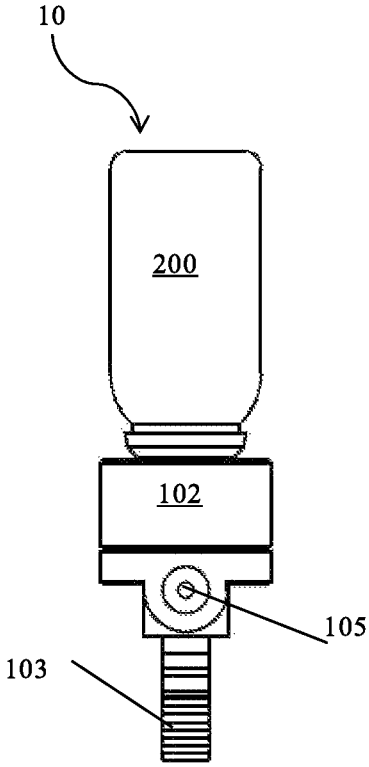
Figure 8A:
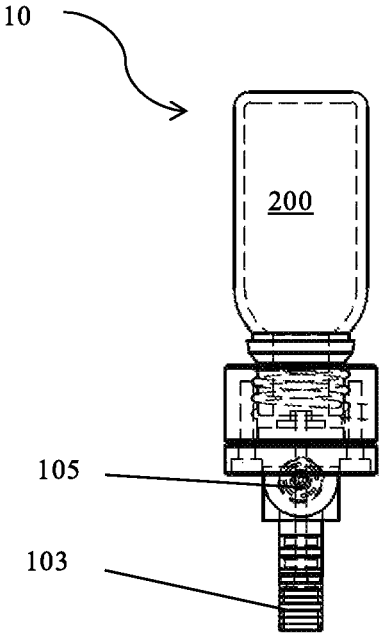
FIGS. 8*a*, 8*b* and 8*c* show equivalent side views to FIGS. 7*a*, 7*b* and 7*c* respectively, with internal detail shown in dotted lines.
Figure 8B:
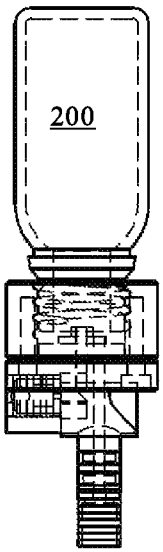
Figure 8C:
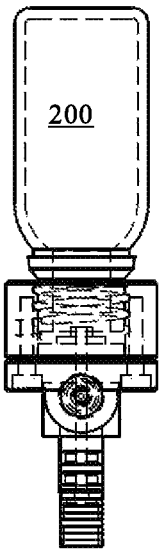

For convenience, the concepts are described herein in the context of adding an essential oil (also known as an aromatherapy oil) to a liquid stream (e.g. water).

According to a first aspect, there is provided a liquid dosing apparatus for dispensing a liquid from a container into a liquid stream of a shower, toilet or tap. The apparatus comprises:

a dosing mechanism comprising a dosing chamber and a moveable member, and arranged to draw a set volume of the liquid into the dosing chamber on activation, activation comprising moving the moveable member in a first direction;

a damping control system arranged to control a dispensing rate of the set volume of the liquid by controlling return speed of the moveable member; and a dispensing outlet arranged to dispense the liquid into the water stream at the controlled dispensing rate.

According to a second aspect, there is provided a dosing apparatus for dispensing a liquid through a dispensing outlet comprising:

an adapter arranged to engagingly receive a container of liquid and comprising a first one-way valve arranged to allow liquid flow out of the container and prevent liquid flow into the container;

a dosing mechanism comprising a dosing chamber and a moveable member, and arranged to draw a set volume of the liquid into the dosing chamber on activation, activation comprising moving the moveable member in a first direction; and a damping control system arranged to control dispensing rate of the set volume of the liquid, the damping control system comprising:

a hydraulic piston within a charging chamber containing hydraulic fluid, wherein the hydraulic piston is arranged to be driven so as to move a quantity of hydraulic fluid from the hydraulic charging chamber and through a second one-way valve and to a sprung damping chamber when the dosing mechanism is activated; and a return channel across the second one-way valve, wherein the return channel is arranged to limit the rate at which the hydraulic fluid can pass therethrough;

wherein the sprung damping chamber is arranged to absorb the volume of the displaced hydraulic fluid while creating a spring force to complete a return cycle of the dosing mechanism, the spring force driving the hydraulic fluid in the return direction via the flow valve.

The skilled person will appreciate that the apparatus of the second aspect may be arranged to function as the apparatus of the first aspect. The dispensing outlet may be connected to a water stream, optionally a shower, toilet or tap water stream. One such embodiment provides a dosing apparatus for dispensing a liquid through a dispensing outlet, and optionally into a liquid stream of a shower, toilet or tap, the apparatus comprising:

an adapter arranged to engagingly receive a container of liquid and comprising a first one-way valve arranged to allow liquid flow out of the container and prevent liquid flow into the container;

a dosing pump comprising a dosing piston with a barrel and arranged to draw a set volume of the liquid through the adapter and into the barrel when activated; and a damping control system arranged to control dispensing rate of the set volume of the liquid, the damping control system comprising:

a hydraulic piston within a charging chamber containing hydraulic fluid, wherein the hydraulic piston is arranged to be driven so as to move a quantity of hydraulic fluid from the hydraulic charging chamber and through a second one-way valve and to a sprung damping chamber when the dosing pump is activated; and a return channel across the second one-way valve, wherein the return channel is arranged to limit the rate at which the hydraulic fluid can pass therethrough;

wherein the sprung damping chamber is arranged to absorb the volume of the displaced hydraulic fluid while creating a spring force to complete a return cycle of the dosing pump, the spring force driving the hydraulic fluid in the return direction via the flow valve.

In the apparatus of either aspect, the damping control system may be arranged to allow and control adjustment of the dispensing rate.

Advantageously, a user can therefore adjust the rate at which/the duration of time over which the liquid is dispensed In such embodiments, the damping control system may be arranged such that the dispensing rate can be varied between no restriction of the return channel, and hence near-instant dispensing of the set volume on activation, and sufficient restriction to spread dispensing over a set time period.

In the apparatus of either aspect, when the damping control system has the components specified for the second aspect, the damping control system may comprise a flow valve arranged to provide at least a part of the return channel across the second one-way valve, and the flow valve may be arranged to adjustably limit the rate at which the hydraulic fluid can pass therethrough.

In embodiments with such an adjustable return channel, the apparatus may comprise a damping control mechanism arranged to allow adjustment of the flow valve. Optionally, in these embodiments, the damping control mechanism comprises a control dial or slider arranged to indicate dispensing time for a given setting.

The container may be a standard aromatherapy oil bottle.

The container may have an opening through which the liquid is arranged to pass, and, in use, the container may be positioned such that the opening is the lowest part of the container. Gravity may therefore assist draining of the container's contents.

In embodiments with an adapter, the adapter may be part of a cartridge arranged to engagingly receive the container. The cartridge may arranged to be removably attached to both the container and the dosing mechanism.

In such embodiments, the adapter may be arranged to serve as a lid for the container, potentially retaining any remaining liquid within the container when the cartridge is removed from the rest of the dosing apparatus. Additionally or alternatively, the cartridge is arranged to be a press-fit with a housing of the dosing mechanism for ease of attachment and removal.

The adapter may comprise an air-replenishment valve to allow air into the container in place of the liquid extracted.

The set volume may be arranged to be adjusted by a user.

In embodiments with an adapter, the adapter may be located above the dosing mechanism such that the liquid travels downwards from the container into the dosing chamber when activated.

The dosing mechanism may be arranged to be activated using a dose activator. The dose activator may comprise a dose button, such as a push button or a pull or twist or lever-style button.

The dose activator may comprise a slider which is arranged to be moved downwards to move the moveable member downwards, and which is pulled back up by the dosing apparatus as the moveable member is raised during the return cycle. The dose activator or dose button may travel vertically or horizontally or at any angle therebetween. The line of movement of the dose activator may be chosen to provide ergonomic use, amongst other things. Slider position may be arranged to indicate how much of the set volume has been dispensed.

The dose activator may operate the slider directly without any intervening mechanism. Or, the dose activator may operate the slider indirectly, e.g. via one or more gears or levers, perhaps a series of gears or levers.

The liquid may be an aromatherapy oil, liquid soap, fragrance, or shower gel.

In embodiments with a sprung damping chamber, the spring force of the sprung damping chamber may be provided by a biasing member comprising at least one of:

a spring; compressible foam; memory metal; an air bubble; and an elastic compressible material such as rubber.

The dispensing outlet may be adjacent to the exit point for liquid from the dispensing chamber.

The dosing mechanism may be a dosing pump comprising a dosing piston with a barrel, the barrel forming the dosing chamber and the piston forming the moveable member. The dosing piston may be arranged to draw a set volume of the liquid into the barrel on activation, activation comprising moving the dosing piston in a first direction. The damping control system may be arranged to control a dispensing rate of the set volume of the liquid by controlling return speed of the dosing piston.

In such embodiments, the first direction may be downwards, such that the dosing piston is drawn downwards to draw the liquid into the dosing chamber, and is moved upwards by the return of the hydraulic fluid.

According to a third aspect there is provided a shower control box or tap comprising a dosing apparatus according to the first or second aspect.

According to a fourth aspect there is provided an adapter for an aromatherapy oil bottle, the adapter being releasably attachable to a dosing apparatus. The apparatus comprises:

a thread arranged to engagingly receive the neck of the bottle, so as to form a seal therewith;

an outlet arranged to allow a liquid within the bottle to pass therethrough; and a one-way valve arranged to allow air into the bottle, wherein the one-way valve is arranged such that air can enter the bottle only when the liquid is drawn out of the bottle via the outlet, and wherein the outlet is arranged such that the liquid cannot pass through the outlet unless a force is applied to the liquid.

The dosing apparatus may be as described with respect to the first and/or second aspect.

The outlet may comprise an elongate projection with a passageway therethrough, the elongate projection being oriented away from the bottle.

The adapter may be arranged to be a push-fit with the dosing apparatus.

The outlet and one-way valve may be arranged such that liquid is only drawn through the outlet when a pressure differential between air near the inlet of the one-way valve and the outlet exceeds a threshold.

The skilled person will appreciate that features discussed in relation to any one aspect may be provided with any other aspect.

Turning now to the accompanying drawings, FIG. 1 shows a dosing apparatus 100 with an aromatherapy oil bottle 200 mounted thereon. The liquid is therefore aromatherapy oil in the embodiment being described, although the skilled person will appreciate that any liquid or mixture of liquids, including creams and gels, may take the place of the aromatherapy oil in other embodiments.

The skilled person will appreciate that, in other embodiments, other bottles 200 or containers may be mounted, or a reservoir may be provided within the dosing apparatus 100 and an additive liquid may be poured into the reservoir, instead of mounting a separable container of the additive.

The bottle 200 is mounted with its opening downwards so that gravity can assist draining of the bottle 200. Wastage may therefore be minimal, as the liquid drains from the bottle 200 by gravity by way of the bottle 200 being turned upside down with respect to its normal position. In alternative embodiments, a bottle spring loaded (or otherwise urged using different mechanism) to provide a force on the liquid within towards the opening of the bottle could be used to allow the bottle to be loaded in the standard (upright, i.e. opening directed upwards) position whilst potentially reducing wastage as compared to suction pipe arrangements for upright bottles.

An adapter 102 is provided, the adapter 102 being arranged to receive a neck of the bottle 200. The adapter 102 has a thread sized to match the thread on the neck of the bottle 200. The adapter thread allows the bottle 200 to be securely fitted to the adapter 102 and seals it in place.

In the embodiment being described, the bottle 200 is a standard aromatherapy oil/essential oil bottle—the present standard is standard DIN168 glass bottle vials and the adapter 102 of the present application is sized and shaped for use with these bottles 200. The skilled person will appreciate that, in alternative embodiments, adapter shape and dimensions may be adjusted to accommodate other bottle shapes and sizes.

The bottle 200 is attached to the adapter 102 by rotating the thread of the bottle 200 into the adapter 102 until it meets a sealing face within the adapter 102. The adapter 102 then seals the inside of the bottle 200 from the outside air to prevent damage to its contents—which may be oils, scents, creams, medicated preparations, health or flavoring additives for drinking water, additives into tap water to aid shaving or wellness activities (e.g. steaming with menthol) etc.

In use, the neck of the bottle 200 is screwed into the adapter 102. In alternative embodiments, the bottle 200 or other container may be a push-fit with the adapter 102, clipped, screwed or glued to the adapter 102, or connected in any other way. In other embodiments, the adapter 102 may be integral with the container 200, the adapter 102 and container 200 together forming a detachable and replaceable cartridge 10 for use with the dosing apparatus 100.

The cartridge 10—either as a single unit or as a combination of a detachable adapter 102 and bottle 200—provides a simple and convenient way of swapping additive liquids. A user may want multiple different additives at different stages of a shower, for example. The cartridge 10 may be easily removed and replaced, without removing the adapter 102 from the bottle 200. The adapter 102 serves as a lid for the bottle 200 when the bottle 200 is not connected to the dosing apparatus 100.

The adapter 102 comprises an outlet 103. The outlet 103 is where the additive in the bottle 200 is dispensed from. In the embodiment being described, the outlet 103 extends downwardly from and parallel to the length of the bottle. Gravity therefore assists in extracting as much of the liquid as reasonably possible from the bottle 200.

In the embodiment being described, the outlet 103 is also used to mount, orientate and seal the adapter 102 into the dosing apparatus 100. The outlet 103 comprises a hollow elongate projection, in this case a tube, arranged to fit within the apparatus 100 in the embodiment being described (in this case, within a pipe 130 of the apparatus), so as to facilitate the outlet's mounting and orientation functions.

In the embodiment being described, the outlet 103 comprises a passage with a one-way valve. The one-way valve is arranged to allow liquid within the bottle 200 to leave the bottle, and to prevent the return of liquid into the bottle. In alternative embodiments, the outlet 103 may not have a one-way valve, and may instead be an unimpeded passage. In such cases, the passage is narrow (such that the liquid does not spill) and pressures are arranged such that the liquid will not pass through the outlet 103 unless drawn through, as described below.

In the embodiment being described, the adapter 102 comprises an air replenishment valve 105. The air replenishment valve 105 allows in air to replace the volume of liquid removed from the bottle 200, so preventing vacuum effects from retaining liquid within the bottle 200. The air replenishment valve 105 does not allow the passage of liquid therethrough. The air replenishment valve 105 is a one-way valve such that air cannot leave the bottle 200 via the air replenishment valve 105.

In the embodiment being described, a channel leads from the air replenishment valve 105 to the upper surface of the adapter 102, so providing a route for air to pass into the bottle 200, separate from the outlet 103.

Conveniently, having the outlet 103 and the air-replenishment valve 105 located in an adapter 102 that is a screw-fit with the bottle 200 allows standard bottles 200 to be used without modification.

The air replenishment valve 105 is used in the adapter 102 to maintain a seal on the bottle 200 once it is fitted to the adapter 102. This valve 105 prevents the bottle's contents escaping, and also allows air into the bottle when the liquid is drawn down into the rest of the apparatus 100 for use, so as to prevent a hydraulic or vacuum lock.

In alternative or additional embodiments, a small hole in an upper surface (in the orientation shown, i.e. the far end of the bottle from its opening) of the bottle 200 may be used instead of, or as well as, an air replenishment valve 105, and/or the air replenishment valve may be located differently with respect to the adapter 102 and bottle 200. In embodiments in which a hole is provided instead of an air replenishment valve 105, a one-way valve is provided in the outlet 103.

In other embodiments, there may be no air replenishment valve, nor a hole. In such embodiments, the container 200 may or may not be compressible to reduce vacuum effects.

In the embodiment being described, the adapter 102 is connected to a housing 400 of the dosing apparatus. The adapter 102 is a push-fit with the housing 400 in this embodiment, and can be attached and detached in this way. In the embodiment being described, formations 601 on one or more surfaces of the adapter 102 are provided to releasably interlock with corresponding formations on the housing 400. In alternative or additional embodiments, other connection means may be used, or the adapter 102 may be integral with the housing 400.

In embodiments wherein the adapter 102 is detachable from the housing 400, the adapter 102 allows a user to rapidly change from one bottle 200 to another without switching the apparatus 100 off or unscrewing the bottle 200. The entire cartridge (i.e. adapter 102 and bottle 200) is exchanged with another. Once the bottle 200 fitted to the adapter 102 is exhausted, the bottle 200 can be removed from the adapter 102 and replaced or recharged.

The dosing apparatus 100 comprises a dosing pump 104. In the embodiment being described, the dosing pump 104 is located below the one-way valve 103 to facilitate drawing the liquid out of the bottle 200 and into the dosing pump 104.

The dosing pump 104 has a dosing pump housing 104 which includes a docking member 132 arranged to receive the adapter 102. In the embodiment being described, the adapter 102 is pushed into the top of the dosing pump housing 104, engaging with the docking member 132 and sealing the adapter 102 in place.

In embodiments with an in-built reservoir for the additive liquid instead of an adapter 102 for a separable container 200, the reservoir would take the place of the docking member 132.

The dosing pump 104 has a barrel 109 and a dosing piston (not shown—covered by the dosing pump housing 104). A nozzle 107 extending from the barrel 109 provides a route for liquid to enter and leave the barrel 109.

The barrel 109 forms a dosing chamber—a set volume (dose) of liquid is drawn out of the bottle 200 and into the barrel 109 when the apparatus 100 is activated.

The dosing pump 104 has a dose button 150 which can be used to activate the apparatus 100, i.e. which is a dose activator. The dose button 150 is—directly or indirectly, electrically and/or mechanically—connected to the dosing piston. A slider or other control means, including an electronic interface such as a graphical user interface, may be provided in additional or alternative embodiments.

When the dose button 150 is driven (manually or electro/mechanically driven), the connected dosing pump piston is moved away from the adapter 102, drawing a vacuum on the contents of the bottle 200. The suction/vacuum created is sufficient to open the air replenishment valve 105 in the adapter 102, allowing air to enter and the liquid in the bottle to fill the space in the dosing pump barrel 109. The suction applied therefore allows liquid to be drawn out of the bottle 200, with air passing into the bottle 200 via the air replenishment valve 105 to take its place. This can be thought of as a pressure differential between air near the inlet of the one-way valve and the outlet needing to exceed a threshold (with the pressure at the outlet being lower) for the liquid to pass through the outlet 103.

In various embodiments, the dose button 150 may be a push button, lever, rotatable knob, pull cord or other interface, including an electronic user interface, or any other suitable activation means. The skilled person will appreciate that, although the term "button" is used for clarity with reference to the drawings, any suitable interface known in the art may be used. The does button 150 may travel vertically or horizontally or at an angle with travel of movement appropriate for good ergonomic use, and that movement may be used to move the moveable member (in this case the dosing piston). In embodiments with an electronic interface, the movement (if any—there would be no movement for a graphical user interface "button") or activation of the button 150 causes an electrical signal which causes the moveable member to move, instead of moving it directly.

In the embodiment being described, the space is a set volume such that the same dose of liquid is taken in with each activation. In alternative or additional embodiments, the dose button 150 may be substituted with a different control means allowing adjustment of the set volume—the dosing pump piston can be drawn down by a differing amount so as to vary the amount of liquid taken from the bottle 200.

The liquid from the bottle 200 remains in the dosing pump barrel 109 until the pump piston is driven (upwards) delivering the liquid through a dispensing outlet 170.

In the embodiment being described, the outlet 170 is connected to a water stream for dispersion in a shower, bath or faucet outlet. In the embodiment being described, a pipe 130 provides a T-junction—the water stream enters through one opening 172 and leaves through a second opening 170, carrying with it the additive. The third branch of the T-junction is in fluid communication with, and adjacent to, the nozzle 107 and the bottle outlet 103.

In alternative embodiments, the outlet 170 may be arranged such that the liquid is dispensed onto an absorbent material, into a vessel, through a direct dispensing tube or onto a heat source, or the likes.

In normal use, the liquid cannot be pushed back into the bottle 200 as the one-way valve and outlet system 103, 105 in the adapter 102 restricts any flow back into the bottle. The liquid from the barrel 109 flows through to the water stream as it is the path of least hydraulic resistance.

In the embodiment being described, a pipe 130 connects the adapter 102 to the nozzle 107 of the barrel 109. The pipe also connects the nozzle 107 to the outlet 170, which is a water stream in the embodiment shown.

In the embodiment being described, the nozzle 107 is located close to both the outlet 103 of the adapter 102 and the dispensing outlet 170; the length of the pipe 130 is therefore relatively short. Advantageously, this may help to minimize or avoid purging requirements to flush unused liquid out of the dosing apparatus 100.

The rate at which the pump piston is driven back to its initial, pre-activation, position (i.e. upwards in the embodiment shown) is controlled by the damping control system 300.

As the dose button 150 is activated, driving the pump piston (downwards), a connected hydraulic piston is similarly driven within a hydraulic charging chamber 108. The hydraulic piston, when driven, moves a quantity of hydraulic fluid from the hydraulic charging chamber 108 into a passageway 114. The passageway is provided by a series of oilways and/or pipes/tubes 114 in the embodiment being described.

A hydraulic filling port 180 is provided to allow the hydraulic fluid to be drained, replaced or topped up, as appropriate.

The damping control system 300 uses and controls the movement of the hydraulic fluid so as to control the return rate of the pump piston, and hence the dosing rate.

The damping control system 300 comprises four functional elements—a damping one-way valve 110, a sprung damping cylinder 106, a flow valve 112 and damping control setting 162.

The one-way valve 110 allows the hydraulic fluid driven from the hydraulic charging chamber 108 to travel through the passageway 114 to the sprung damping cylinder 106.

The sprung damping cylinder 106 takes in the volume of displaced hydraulic fluid while creating a spring force to complete the return cycle of the dosing pump 104.

The sprung damping cylinder 106 comprises a biasing member, in this case a spring (foam, another compressible elastic material, memory metal or an air bubble, etc. may be used in alternative or additional embodiments). The biasing member moves proportionally with the volume of hydraulic fluid displaced into the sprung damping cylinder 106. As the hydraulic fluid moves the spring, a force in the spring is created which is sufficient to return the hydraulic piston, and thereby the dosing piston, to its initial position, and therefore dispense the liquid via the dispensing outlet 170.

The spring force acts upon the hydraulic fluid, driving it in the return direction. The hydraulic fluid is unable to return through the damping one-way valve 110 and is directed to a return channel including the flow valve 112 to limit the rate at which it can pass.

The setting of the flow valve 112 can be adjusted to restrict or widen the return channel, so reducing or increasing the rate at which hydraulic fluid can pass therethrough, respectively. The fluid passing through the return channel enters the hydraulic charging chamber 108 and so moves the hydraulic piston back to its initial position at a rate corresponding to the flow rate through the flow valve 112.

In the embodiment being described, the flow valve 112 can be configured from a level of no restriction, and so near-immediate dispensing of the full dose, to a restriction slowing the dosing rate to extend over a duration desired for the application.

In the case of aromatherapy oils, for example, only a small amount of oil is needed for the desired effect, but the dispensing of this small amount is ideally performed over a relatively long time period (e.g. the several minutes taken to have a shower) rather than immediately.

The skilled person will appreciate that aromatherapy dosing will depend on the quality of the oil used and the user preference as to the strength of the scent. This user-set duration may range from 1 second to 30 seconds, to 1, 2, 4, 10, or 15 minutes, for example.

The skilled person will appreciate that the desired duration, and also the available settings, may vary between different embodiments and uses—for example, a dispensing time of approximately 3 minutes may be selected for aromatherapy oil release during a shower. The skilled person will appreciate that the control may offer two or more discrete flow rate options or a continuous range.

Desired duration is also likely to change depending on the chemistry of the liquid to be dispensed. For example, bleach in a toilet should be dispensed for a certain duration and in the correct volume to be at the correct concentration to be effective. The dosing duration in this application may be pre-set based on the relationship between the quantity of water used during a flushing activation and the appropriate chemical concentration required to be effective in its disinfection/cleaning task. An equivalent approach may apply to other alternative chemical dosing applications.

The damping control setting 160, 162 allows the delivery time of the dosing apparatus to be configured.

In the embodiments being described, the dispensing rate is controlled by the piston movement, not by the flow rate of the water of the water stream into which the liquid is to be dispensed. The same quantity of liquid is dispensed over the controlled time period, although the additive liquid to water ratio would change depending on flow rate of the water.

The damping control setting 160, 162 comprises a control dial 160 directly or indirectly connected to the flow valve 112. In the embodiment being described, movement of the control dial 160 causes movement of a toothed wheel 162 which interlocks with a cog of the flow valve 112 so as to tighten or loosen the valve 112. The skilled person will appreciate that many alternative or additional control means may be used, including use of a graphical user interface and electronically controlled flow valve 112.

In the embodiment being described, the control dial 160 is arranged to protrude through a housing 400 of the apparatus 100. The damping control system 300 is calibrated and the housing 400 is marked or labelled to indicate a dosing duration corresponding to each dial position.

In the embodiment being described, the flow valve 112 is an adjustable needle valve.

A user of the apparatus 100 can adjust the damping control setting to a preferred or appropriate setting (e.g. corresponding to a duration of time) before the dose button 150 is driven.

In alternative embodiments, no flow valve 112 and damping control setting 160, 162 may be provided. Instead, the return channel may comprise a narrow channel of a fixed size (e.g. simply a hole, or a non-adjustable needle valve) so as to limit return flow of the hydraulic fluid. The rate of return of the piston is therefore constant. In such cases, the duration of the dosing is fixed for a given volume of hydraulic fluid displaced, and therefore for a given volume of liquid dispensed. A constant dosing rate (as compared to a constant duration) may therefore be provided for various different volumes of liquid, in embodiments in which the set volume can be adjusted.

In the embodiment being described, once the dose button 150 is driven, the damping control setting selected corresponds to the duration of time over which the dosing pump 104 will deliver the dose into the water stream.

In the embodiment being described, the dosing apparatus 100 is provided as a stand-alone box to be fitted to a standard shower or tap outlet. For a shower, the box would be fitted between a shower control box and a shower head. In alternative embodiments, the dosing apparatus 100 may be integrated into a shower control box. In either case, it may be used with hand-held showers and with wall- or ceiling-mounted showers (e.g. overhead showers).

The skilled person will appreciate that dose volume and time of delivery of each dose can be scaled for different applications.

The duration of delivery of each dose is also scalable from instantaneous delivery to delivery over long periods of time.

The system is designed to dose liquids, including gels and creams in this definition. Different viscosity materials may require different engineering details, e.g. different widths of the return channel, increased air pressure or a piston to remove bottle contents, etc., but can use the same principles.

Advantageously, very little purging of the apparatus 100 may be required, as the dosing pump 104 can be located at a minimal distance from the dispensing outlet 170 (in the embodiment shown, the water stream). Any liquid is therefore delivered directly out of the dispensing outlet 170, in this case into the water stream.

In the embodiment being described, once the essential oil (or other liquid) is dosed, the nature of the water stream flushes the area reducing the need to purge between different essential oils (or other liquids).

In alternative or additional embodiments, the dosing piston may be replaced by a different moveable member, and the dosing piston barrel may be replaced with a different dosing chamber. For example, the dosing chamber may be expansible (e.g. a balloon or the likes) and the moveable member may be a member that forces expansion of the dosing chamber when activated, so reducing pressure within the chamber and drawing the additive out of the container 200.

The skilled person will appreciate that, with the disclosure of the underlying damping control mechanism and the examples given herein, the skilled person could make various alternative dosing mechanisms using his or her general knowledge.

What is claimed is:

1. A dosing apparatus for dispensing a liquid through a dispensing outlet comprising:

an adapter arranged to engagingly receive a container of liquid and comprising a first one-way valve arranged to allow liquid flow out of the container and prevent liquid flow into the container;

a dosing mechanism comprising a dosing chamber and a moveable member, and arranged to draw a set volume of the liquid into the dosing chamber on activation, wherein activation comprises moving the moveable member in a first direction; and a damping control system arranged to control dispensing rate of the set volume of the liquid, the damping control system comprising:

a hydraulic piston within a charging chamber containing hydraulic fluid, wherein the hydraulic piston is arranged to be driven so as to move a quantity of hydraulic fluid from the hydraulic charging chamber and through a second one-way valve and to a sprung damping chamber when the dosing mechanism is activated; and a return channel across the second one-way valve, wherein the return channel is arranged to limit the rate at which the hydraulic fluid can pass therethrough;

wherein the sprung damping chamber is arranged to absorb the volume of the displaced hydraulic fluid while creating a spring force to complete a return cycle of the dosing mechanism, the spring force driving the hydraulic fluid in the return direction via the flow valve.

2. The dosing apparatus of claim 1, wherein the damping control system is arranged to allow and control adjustment of the dispensing rate and comprises a flow valve arranged to provide at least a part of the return channel across the second one-way valve, wherein the flow valve is arranged to adjustably limit the rate at which the hydraulic fluid can pass therethrough.

3. The dosing apparatus of claim 1, wherein the adapter is part of a cartridge arranged to engagingly receive the container, and wherein the cartridge is arranged to be removably attached to both the container and the dosing mechanism.

4. The dosing apparatus of claim 3, wherein the adapter is arranged to serve as a lid for the container, retaining any remaining liquid within the container when the cartridge is removed from the rest of the dosing apparatus.

5. The dosing apparatus of claim 3, wherein the cartridge is arranged to be a press-fit with a housing of the dosing mechanism for ease of attachment and removal.

6. The dosing apparatus of claim 1, wherein the adapter comprises an air-replenishment valve to allow air into the container in place of the liquid extracted.

7. The dosing apparatus of claim 1, wherein the adapter is located above the dosing mechanism such that the liquid travels downwards from the container into the dosing chamber when activated.

8. The dosing apparatus of claim 1, wherein the dispensing outlet is connected to a shower, toilet, or tap water stream.

9. The dosing apparatus of claim 1, wherein the spring force of the sprung damping chamber is provided by a biasing member comprising at least one of:

a spring;
compressible foam;
memory metal;
an air bubble; or
an elastic compressible material.

* * * * *